US005822952A

United States Patent [19]

Boldrini

[11] Patent Number: 5,822,952

[45] Date of Patent: Oct. 20, 1998

[54] METHOD AND UNIT FOR FORMING AND WRAPPING GROUPS OF CIGARETTES

[75] Inventor: Fulvio Boldrini, Ferrara, Italy

[73] Assignee: G.D Societa' per Azioni, Bologna, Italy

[21] Appl. No.: 873,003

[22] Filed: Jun. 11, 1997

[30] Foreign Application Priority Data

Jun. 12, 1996 [IT] Italy ..... BO96 A 0316

[51] Int. Cl.[6] ..... B65B 11/06; B65B 49/00; B65B 19/22

[52] U.S. Cl. ..... 53/444; 53/446; 53/149; 53/151; 53/228

[58] Field of Search ..... 53/444, 466, 149, 53/150, 151, 148, 228, 229, 234

[56] References Cited

U.S. PATENT DOCUMENTS

| | | | |
|---|---|---|---|
| 2,138,728 | 11/1938 | Chalmers . | |
| 2,867,065 | 6/1959 | Hall . | |
| 3,924,386 | 12/1975 | Schmermund | 53/234 X |
| 4,186,544 | 2/1980 | Johnson | 53/234 X |
| 4,700,825 | 10/1987 | Mattei et al. | 53/444 X |
| 5,353,815 | 10/1994 | Gamberini et al. | 53/234 X |

FOREIGN PATENT DOCUMENTS

| | | | |
|---|---|---|---|
| 295557 | 12/1988 | European Pat. Off. . | |
| 548978 | 6/1993 | European Pat. Off. . | |
| 2243911 | 3/1974 | Germany . | |
| 1761160 | 4/1978 | Germany | 53/149 |

*Primary Examiner*—Linda Johnson
*Attorney, Agent, or Firm*—Marshall, O'Toole, Gerstein, Murray & Borun

[57] ABSTRACT

A method and unit for forming and wrapping groups of cigarettes, whereby cigarettes are fed, crosswise to their respective axes, onto a supporting surface to form, on the supporting surface, a multilayer group located between two opposite retaining heads of a pocket for conveying the group; the two retaining heads leave a lateral surface of the group substantially free, and feed the group along the supporting surface, and crosswise to the respective axes of the cigarettes, through a supply line for supplying sheets of wrapping material.

26 Claims, 5 Drawing Sheets

METHOD AND UNIT FOR FORMING AND WRAPPING GROUPS OF CIGARETTES

BACKGROUND OF THE INVENTION

The present invention relates to a method of forming and wrapping groups of cigarettes.

According to one known method of forming and wrapping groups of cigarettes, each group is formed inside a respective forming pocket into which a given number of cigarettes are inserted, and is then transferred into a wrapping pocket together with a respective sheet of wrapping material, so that the sheet is folded about, and directly in contact with a lateral surface of, the group.

Normally, the forming pockets are substantially U-shaped, and comprise a horizontal bottom wall, and two vertical walls crosswise to the bottom wall and defining with it an open-topped compartment for receiving and retaining the cigarettes correctly positioned in relation to one another by engaging at least three of the four sides of the lateral surface of each group.

Though shown to be relatively effective, the above method presents several drawbacks. That is, though retained during transfer, first from the forming pocket and later from the wrapping pocket, the possibility always exists of the group collapsing by not being in itself set to a given stable configuration. Moreover, the cigarettes may also be damaged as a result of the handling operations required to transfer each group from the respective forming pocket to the respective wrapping pocket

SUMMARY OF THE INVENTION

It is an object of the present invention to provide a straightforward, low-cost method of forming and wrapping groups of cigarettes, designed to overcome the aforementioned drawbacks.

According to the present invention, there is provided a method of forming and wrapping groups of cigarettes, the method comprising the steps of feeding cigarettes, crosswise to their respective axes, into a conveying pocket to form, inside the pocket, a multilayer group of cigarettes; and feeding said group to a wrapping station; characterized in that said group is fed directly to said wrapping station by said pocket, which substantially engages the ends of the cigarettes in the group to leave a lateral surface of the group substantially free.

The present invention also relates to a unit for forming and wrapping groups of cigarettes.

According to the present invention, there is provided a unit for forming and wrapping groups of cigarettes, and comprising a conveyor; at least one conveying pocket movable with said conveyor in a given direction; supply means for feeding cigarettes, crosswise to their respective axes, into said pocket to form, inside the pocket, a multilayer group of cigarettes; and a wrapping station for wrapping said group; characterized in that said wrapping station is located along said conveyor; said pocket being so formed as to substantially engage the ends of the cigarettes in the group to leave a lateral surface of the group substantially free.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
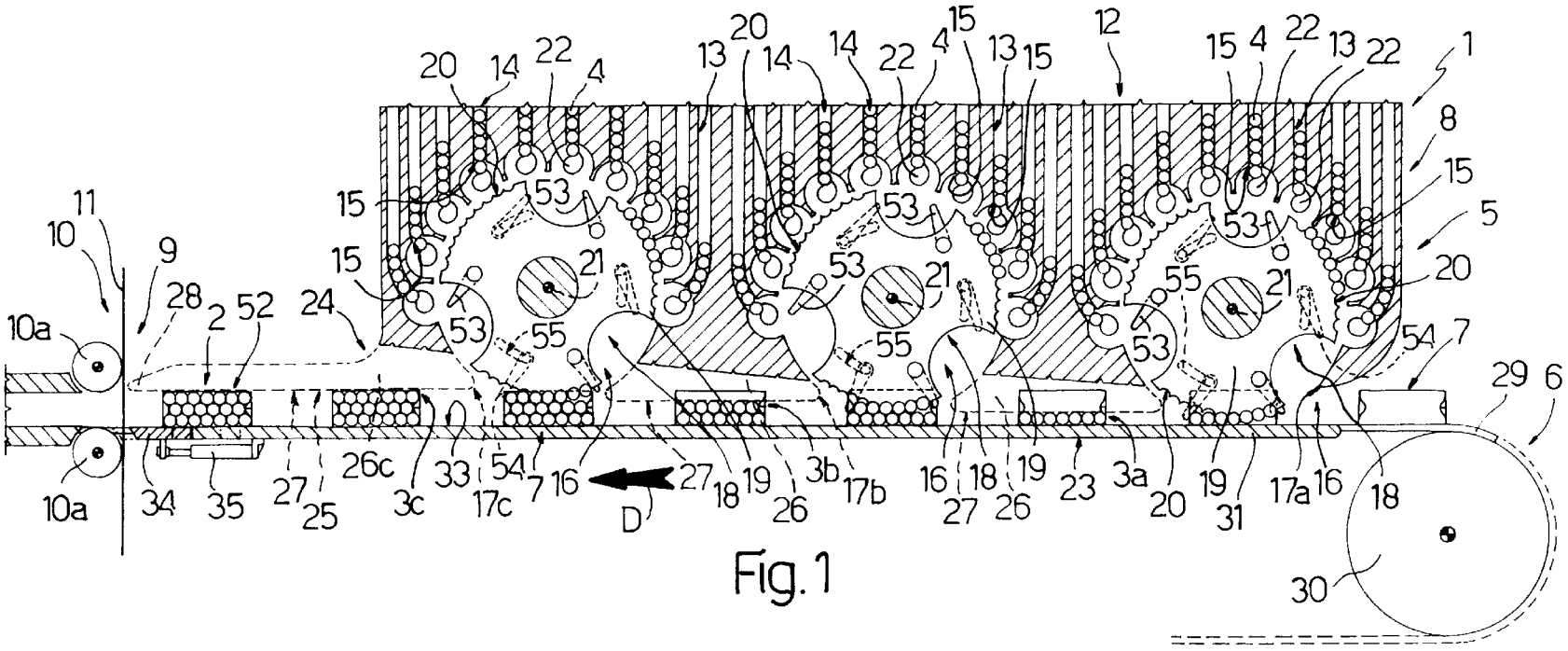
FIG. 1 shows a side view, with parts in section and parts removed for clarity, of a preferred embodiment of the unit according to the present invention.

Number 1 in FIG. 1 indicates a unit for forming and wrapping groups 2, each defined by at least two layers 3 of cigarettes 4.

Unit 1 comprises a forming device 5 for forming groups 2, and which in turn comprises a conveyor 6, and a number of conveying pockets 7 movable with conveyor 6 in a given direction D crosswise to the respective axes of cigarettes 4. Unit 1 also comprises a supply device 8 located substantially over conveyor 6, and for feeding cigarettes 4, crosswise to their respective axes, to conveyor 6.

Finally, unit 1 also comprises a wrapping station 9 located along and downstream from conveyor 6 in direction D; and a supply line 10 for feeding a sheet 11 of wrapping material to station 9 in time with a respective group 2, and for positioning sheet 11 crosswise to direction D so that, in use, sheet 11 is engaged by respective group 2 fed through station 9 by respective pocket 7.

Device 8 comprises a feedbox 12 in turn comprising a number of substantially vertical channels 13 for feeding respective columns 14 of cigarettes 4 by gravity to respective bottom openings 15, and which are divided into groups or outlets 16 at least equal in number to layers 3 in each group 2, and arranged in series along conveyor 6.

Each outlet 16 comprises a respective bottom opening 17 directly facing conveyor 6; and a transfer wheel 18 housed inside outlet 16, in an intermediate position between respective opening 17 and openings 15 of respective channels 13, and having a given number of peripheral suction sectors 19, each with a number of grooves 20 crosswise to direction D. Grooves 20 receive respective cigarettes 4 from channels 13, and retain them by suction by each cooperating with a central portion of respective cigarette 4.

Each wheel 18 rotates clockwise (in FIG. 1) about a respective axis 21 crosswise to direction D and parallel to grooves 20, to feed sectors 19 beneath openings 15, where each sector 19 receives a number of cigarettes 4 less than or at most equal to the number of grooves 20 of sector 19, to form a layer 3 and subsequently feed it through respective opening 17 where each sector 19 feeds respective layer 3 into a conveying pocket 7.

In the example shown, each group 2 comprises three layers 3, of which the middle layer (indicated 3*b*) comprises fewer cigarettes 4 than the bottom layer (indicated 3*a*) and the top layer (indicated 3*c*) so that cigarettes 4 in each group 2 are arranged quincuncially. Also in the example shown, each layer 3 is a complete layer of cigarettes 4, i.e. a layer in which cigarettes 4 are arranged substantially contacting one another.

For each channel 13, supply device 8 comprises a dispensing element 22 located at bottom opening 15 of the channel, and for either arresting cigarettes 4 of respective channel 13 at opening 15, or feeding each cigarette 4 into a respective groove 20 traveling beneath opening 15. Dispensing elements 22 provide for forming complete layers 3, or incomplete layers (not shown) comprising a given number of gaps (not shown) between one cigarette 4 and another.

Alternatively, given the possibility of feeding cigarettes 4 selectively through openings 15, the number of cigarettes 4 in each layer 3 and also the arrangement of cigarettes 4 in each group 2 may differ from the example shown, by dispensing elements 22 providing for supplying only some or all of grooves 20 of each sector 19.

Conveyor 6 comprises a guide 23 extending in direction D up to station 9 and beneath openings 17 of outlets 16, and which defines, with a bottom portion 24 of feedbox 12, a retaining channel 25 increasing in height in direction D, and which is engaged by groups 2 being formed to keep cigarettes 4 in each layer 3 in the correct position. More specifically, portion 24 is defined by three portions 26 located downstream from respective bottom openings 17 in direction D, and having respective bottom surfaces 27 defining an upper surface of channel 25, and the heights of which, with respect to guide 23, increase in direction D according to the number of layers 3 in each group 2 being formed. Each portion 26 cooperates with pockets 7 to keep cigarettes 4 in the correct position in relation to one another by engaging respective central portions of cigarettes 4 in the respective layer 3 deposited last inside pocket 7. The last portion 26 (indicated 26*c*), on the other hand, extends up to station 9, has a bottom surface 27 at a height, over guide 23, equal to the thickness of groups 2, and comprises an end edge 28 flush with line 10 supplying sheets 11.

Figure 2:
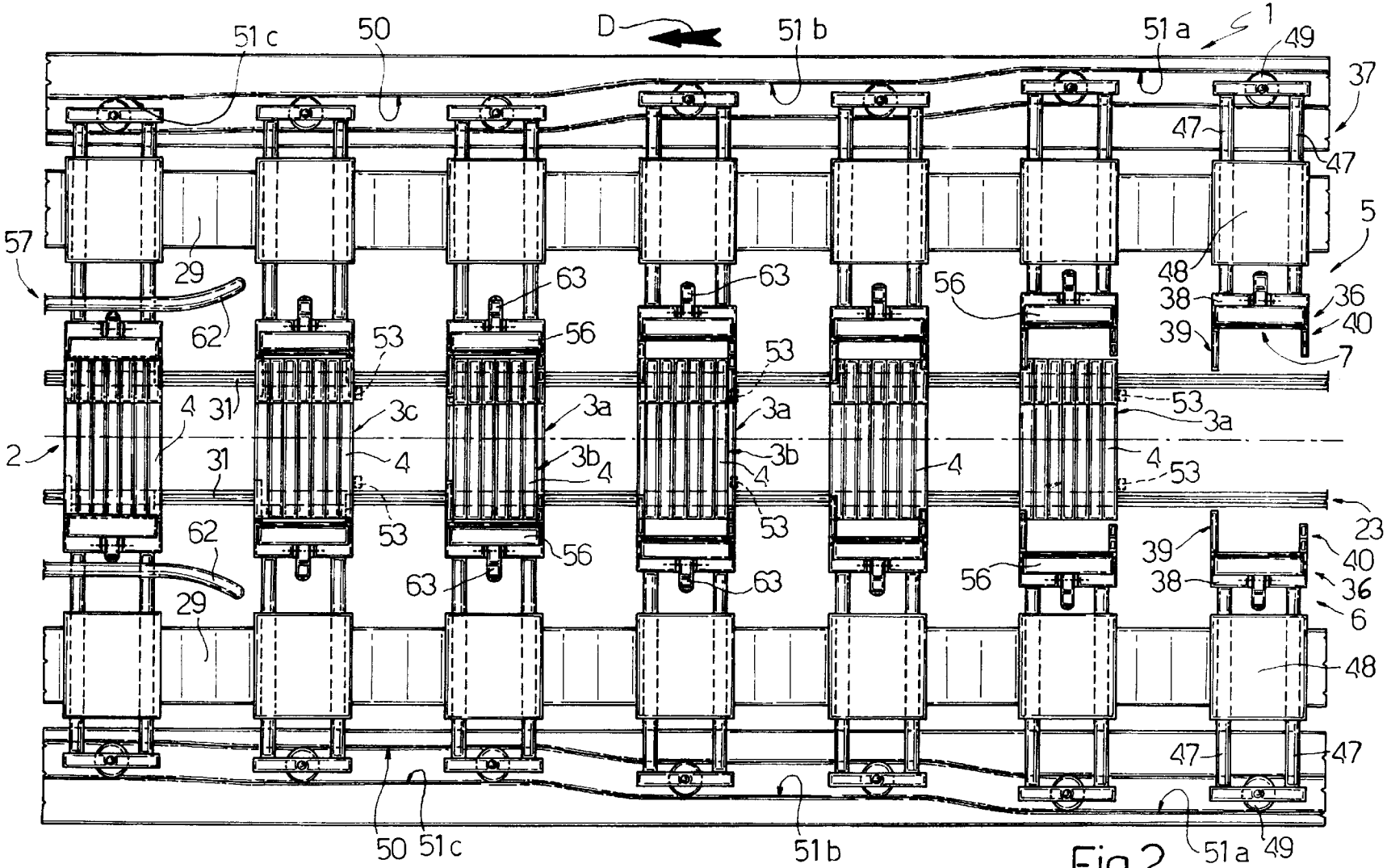
FIG. 2 shows a larger-scale plan view, with parts in section and parts removed for clarity, of a detail in FIG. 1.

As shown in FIG. 2, conveyor 6 comprises two conveyor belts 29, which are located on either side of guide 23, at a distance from each other greater than the length of cigarettes 4, provide for feeding pockets 7 in direction D, and are looped about two pulleys 30 (only one shown) located upstream from feedbox 12 and downstream from station 9 in direction D.

Guide 23 comprises two elongated elements 31 separated by a distance smaller than the length of cigarettes 4, and having, on the top facing feedbox 12, respective pairs of shaped projections 32 defining a supporting surface 33, which cooperates with cigarettes 4 in layers 3*a* to support groups 2 being formed, and in turn defines a bottom surface of channel 25.

Guide 23 also comprises an end plate 34 located between elements 31 at station 9, and which is movable, parallel to direction D, by a linear actuator 35 to enable a sheet 11 to be fed through guide 23. More specifically, plate 34 is movable between a withdrawn position (shown by the continuous line in FIG. 1) in which it is flush with line 10 to enable sheet 11 to be fed to station 9, and an extracted position (shown by the dotted line in FIG. 1) in which it projects with respect to end edge 28 of the last portion 26, to support a group 2 traveling through station 9.

Figure 3:
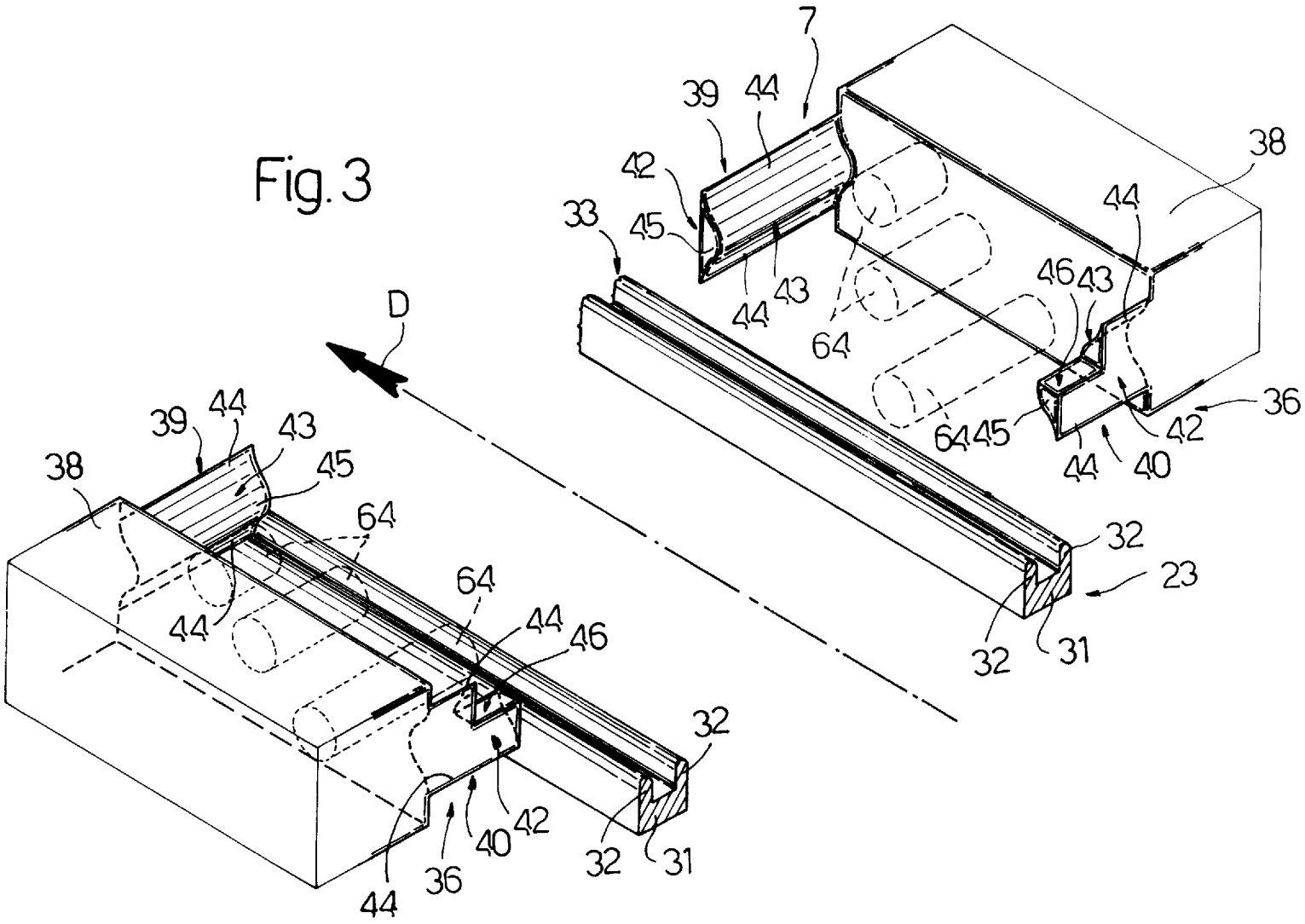
FIG. 3 shows a larger-scale view in perspective, with parts in section and parts removed for clarity, of a detail in FIG. 2.

As shown in FIGS. 2 and 3, each pocket 7 comprises two opposite retaining heads 36 fitted to respective belts 29, movable by an actuating device 37, and each comprising a vertical wall 38 parallel to direction D, and axial appendixes 39 and 40 extending crosswise from wall 38 towards appendixes 39, 40 of the other wall 38. Heads 36 are movable in steps between an open position wherein walls 38 are separated by a given distance greater than the length of cigarettes 4, and appendixes 39, 40 are located outside respective group 2, and a gripping position wherein walls 38 substantially contact the ends of cigarettes 4 of group 2 inside pocket 7, and appendixes 39, 40 are substantially housed inside respective lateral openings 41 defined by the outermost cigarettes 4 in layer 3*b* with the outermost cigarettes 4 in layers 3*a* and 3*c*, and retain cigarettes 4 in group 2 in a direction crosswise to cigarettes 4 and parallel to supporting surface 33.

More specifically, each appendix 39, 40 comprises a flat surface 42 facing outwards of pocket 7; and a shaped surface 43 facing inwards of pocket 7 and defining, with outer surface 42, two tapered longitudinal edges 44, which are positioned flush with respective outer lateral cigarettes 4 in layers 3*a* and 3*c* to retain cigarettes 4 in said crosswise direction. Outer surface 42 is a flat vertical surface, whereas inner surface 43 defines a substantially cylindrical longitudinal projection 45 with a radius of curvature substantially equal to that of the cigarettes, and which occupies respective opening 41 to retain the relevant outermost cigarette 4 in layer 3*b* as pocket 7, in use, feeds forward layers 3*a* and 3*b* and respective group 2.

Appendix 39, which, of appendixes 39, 40 of each head 36, is the one located forwards in the traveling direction of pocket 7, is of a given length L1 greater than the length L2 of appendix 40, which in turn comprises a flat surface 46 formed at one end of respective top edge 44. Flat surfaces 46 extend inwards of respective appendixes 40 by a length L3 substantially equal to half of length L2 and to a third of length L1 and provide for enabling insertion of layer 3*b* into respective pocket 7.

For each head 36, actuating device 37 comprises two rods 47 fitted in sliding manner through a support 48 integral with respective belt 29, and which are connected at one end to vertical wall 38 of respective head 36, and at the opposite end support a tappet roller 49 rotating about a respective vertical axis. For each belt 29, device 37 also comprises a track 50 extending along the side of belt 29, engaged in rolling manner by rollers 49, and comprising a number of straight portions 51, which are equal in number to and located at outlets 16, and extend parallel to direction D and at a given distance from the lateral edge of belt 29.

In the example shown, each track 50 comprises three portions 51*a*, 51*b* and 51*c*. Portions 51*a* provide for positioning walls 38 at a distance D1 from each other, so that appendixes 39 are vertically flush with guide 23 and separated by a distance smaller than the length of cigarettes 4; portions 51*b* are located closer to guide 23 than portions 51*a*, by a distance approximately equal to but no greater than the difference between L1 and L2, and provide for positioning walls 38 at a distance D2<D1 from each other, so that appendixes 40 are vertically flush with guide 23 and separated by a distance smaller than the length of cigarettes 4; and portions 51*c* are located even closer to guide 23 than portions 51*a* and 51*b*, and provide for setting walls 38 to the gripping position with projections 45 of appendixes 39 and 40 housed inside respective openings 41 and substantially contacting cigarettes 4.

Finally, supply line 10 comprises two rollers 10*a*, which are located at station 9, on vertically opposite sides of guide 23 with their respective outer cylindrical surfaces separated by a distance equal to the thickness of group 2, and rotate about respective horizontal axes, crosswise to direction D, to feed sheets 11 crosswise to guide 23, and then act as stops to fold each sheet 11 into a U and directly onto an outer lateral surface 52 of respective group 2. More specifically, surface 52 of each group 2 comprises two large portions defined by the outer surfaces of cigarettes 4 in layers 3*a* and 3*c*, and two small portions defined partly by the outer surfaces of the outer lateral cigarettes 4 in layers 3*a* and 3*c*, and partly by the flat outer surfaces 42 of appendixes 39 and 40.

Operation of unit 1 will now be described with reference to the formation and wrapping of one group 2, and as of the instant in which respective pocket 7 is positioned with walls 38 in the open position, and upstream from the first opening 17 (indicated 17*a*) in direction D.

As of the above condition, conveyor 6 feeds pocket 7 beneath openings 17, at each of which, a sector 19 of each wheel 18 feeds a respective layer 3 of cigarettes into pocket 7.

More specifically, at opening 17*a*, a sector 19 feeds a layer 3*a* of cigarettes 4 through opening 17*a*, so that the first cigarette 4 in layer 3*a* and appendixes 39 of pocket 7 reach the point of contact between the first cigarette 4 and guide 23 in time with each other. As the first cigarette 4 reaches the supporting surface 33 of guide 23, a known distributing device (not shown), common to sectors 19 of all of wheels 18, cuts off suction to the respective groove 20 to release cigarette 4 onto surface 33. More specifically, the distributing device cuts off suction to grooves 20 of each sector 19 so that cigarettes 4 of respective layer 3 are released successively by sector 19.

Since both the first and successive cigarettes 4 in layer 3*a* are released onto surface 33, and appendixes 40 are still too far away to push cigarettes 4 in direction D, each cigarette 4 is pushed forward in direction D by the adjacent following cigarette 4, while the last cigarette 4 is fed forward by a pair of substantially radial arms 53 (only one shown) pivoting on the side of each wheel 18 at the rear end of each sector 19, and which are rotated by a known actuating device (not shown), so that their respective free ends engage the ends of the last cigarette 4 in layer 3 to assist the forward feed of layer 3 in direction D and compact layer 3 inside pocket 7.

Once the whole of layer 3*a* is deposited inside pocket 7, cigarettes 4 are pushed in direction D by arms 53 until, as rollers 49 switch from respective portions 51*a* to respective portions 51*b* of respective tracks 50, walls 38 are brought closer together, so that the bottom longitudinal edges 44 of appendixes 40 contact the last cigarette 4 in layer 3*a*.

Alternatively, in the event said distributing device cuts off suction to all of grooves 20 of sector 19 simultaneously, layer 3*a* is released as the cigarette 4 located substantially in the center of layer 3*a* substantially contacts surface 33. In which case, each layer 3 is compacted both by arms 53 and by a further pair of substantially radial arms 54 (only one shown) pivoting on the opposite end of each sector 19 to arms 53. The free ends of arms 54 cooperate with respective ends of the first cigarette 4 in each layer 3, and are engaged inside respective slots 55 enabling arms 54 to travel along respective sector 19 according to the number of cigarettes 4 fed into grooves 20 of sector 19.

Cigarettes 4 of layers 3*b* and 3*c* are supplied in substantially the same way as described for layer 3*a*, except that cigarettes 4 of layers 3*b* and 3*c* are deposited inside pocket 7 already containing at least one layer 3, which acts as a movable support for the next layers 3, and are compacted by respective arms 53 against projection 45 and top longitudinal edge 44 respectively.

Figure 4:
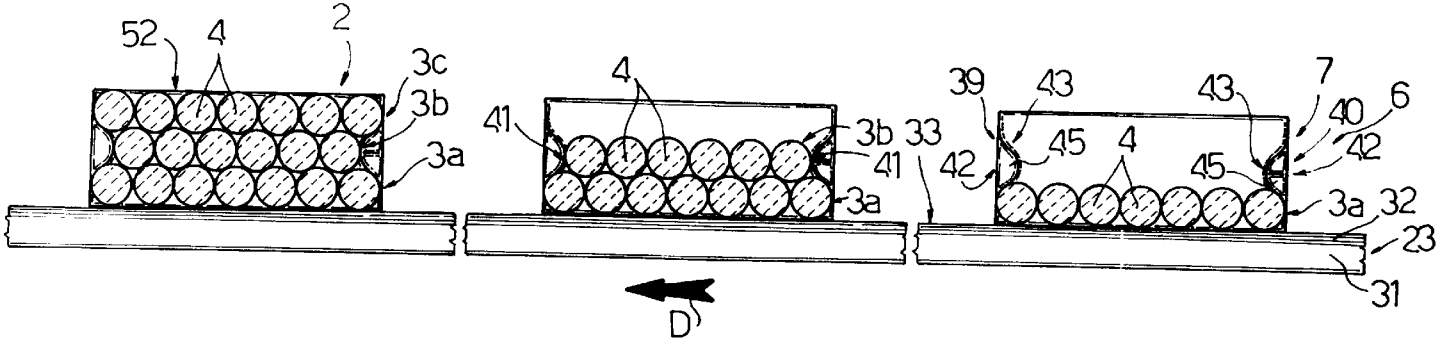
FIG. 4 shows a side view, with parts in section and parts removed for clarity, of the FIG. 3 detail in three different operating conditions.
Figure 5:
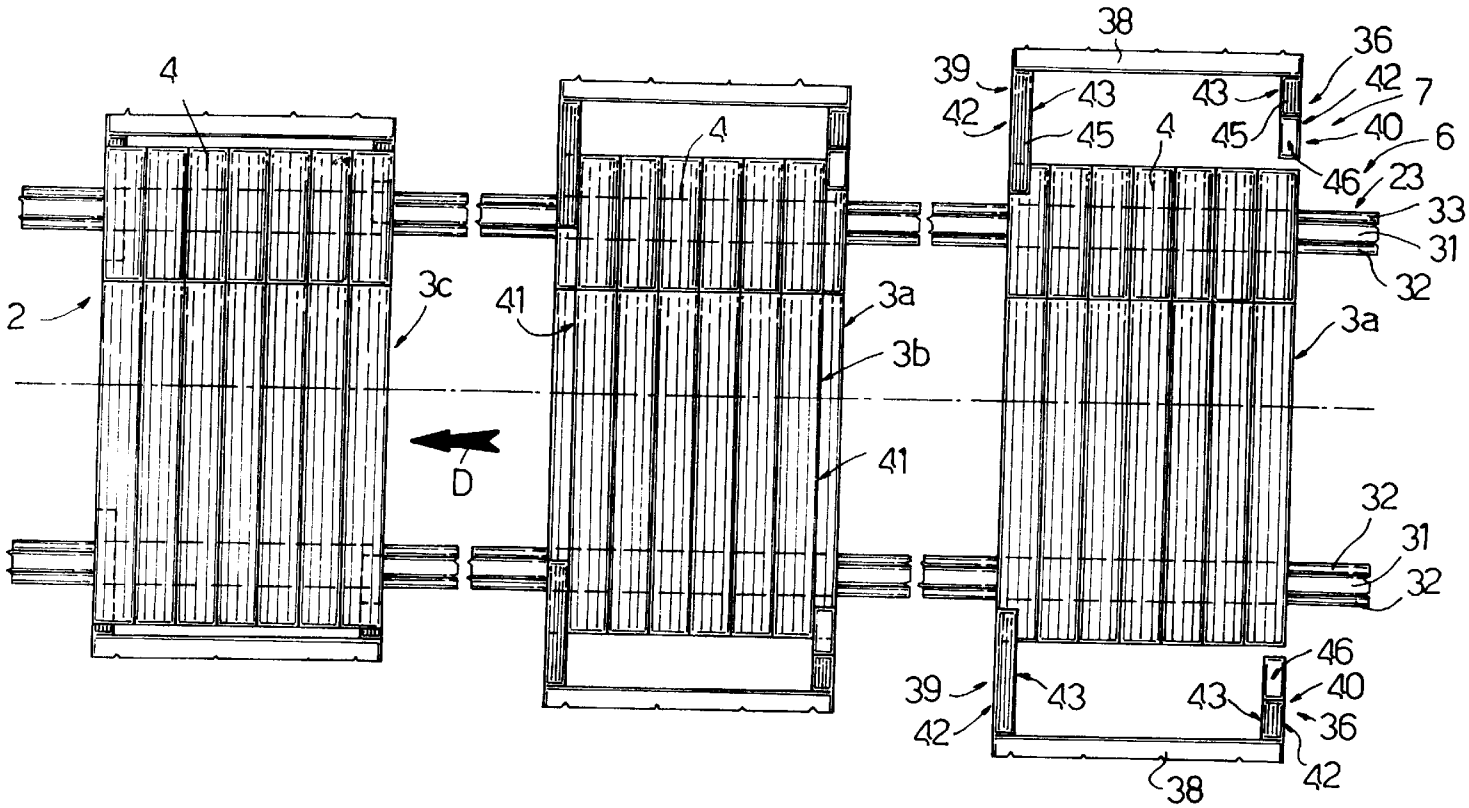
FIG. 5 shows a plan view, with parts in section and parts removed for clarity, of the FIG. 3 detail in three different operating conditions.

As regards the displacement of walls 38 of pocket 7 (FIGS. 4 and 5), by the time rollers 49 switch from portions 51*a* to portions 51*b* as pocket 7 travels in direction D, appendixes 39 and 40 have been brought closer together, as described, with respective bottom longitudinal edges 44 respectively contacting the first and last cigarette 4 in layer 3*a*.

At intermediate opening 17, layer 3*b* is inserted into pocket 7 in substantially the same way as layer 3*a*, which insertion is made possible by flat surfaces 46 on the top longitudinal edges 44 of appendixes 40. Once layer 3*b* has been inserted inside pocket 7, pocket 7 is fed further forward in direction D, and rollers 49 switch from portions 51*b* to portions 51*c* to bring walls 38 even further together and so set pocket 7 to the gripping position.

At this point, pocket 7 is fed beneath the last opening 17 of feedbox 12 to receive layer 3*c*, which is inserted inside pocket 7 as described above.

When group 2 is complete, pocket 7 substantially engages the ends of cigarettes 4 in group 2, the outer lateral surface 52 of which is substantially free and, as pocket 7 travels through station 9, is brought into direct contact with a respective sheet 11 of wrapping material fed beforehand into station 9 by line 10.

As pocket 7 travels further through station 9 and group 2 between the two rollers 10*a*, sheet 11 is folded into a U about group 2 and directly onto surface 52; a known folding device (not shown) subsequently forms a tubular wrapping (not shown) about group 2 by further folding sheet 11; at which point, heads 36 are withdrawn out of the tubular wrapping to enable group 2, together with the tubular wrapping, to be unloaded.

The manner in which each group 2 is formed, and more specifically, in which each layer 3 is fed into and subsequently held in position inside pocket 7, therefore provides, firstly, for extremely delicate handling of cigarettes 4, and, secondly, for forming group 2 in an extremely straightforward manner. In particular, the possibility of supplying wrapping station 9 with group 2 still housed inside conveying pocket 7, and with cigarettes 4 in group 2 held in position in relation to one another by appendixes 39 and 40, provides for forming the tubular wrapping directly about group 2, and so imparting a stable configuration to the group prior to any further transfer, and with no risk of group 2 collapsing.

Figure 7:
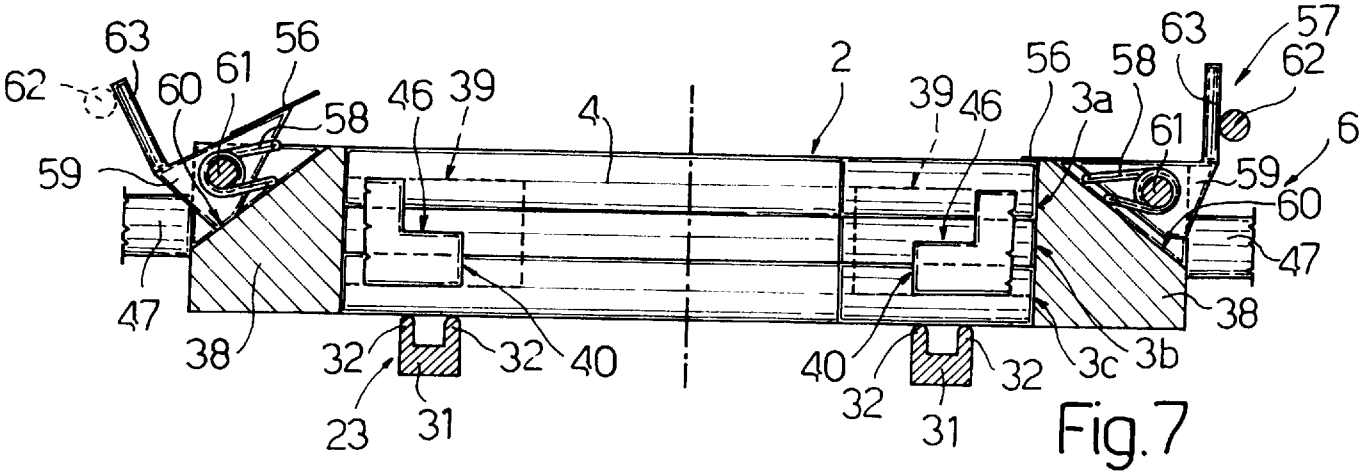
FIG. 7 shows a larger-scale view, with parts in section and parts removed for clarity, of a detail in FIG. 6.
Figure 6:
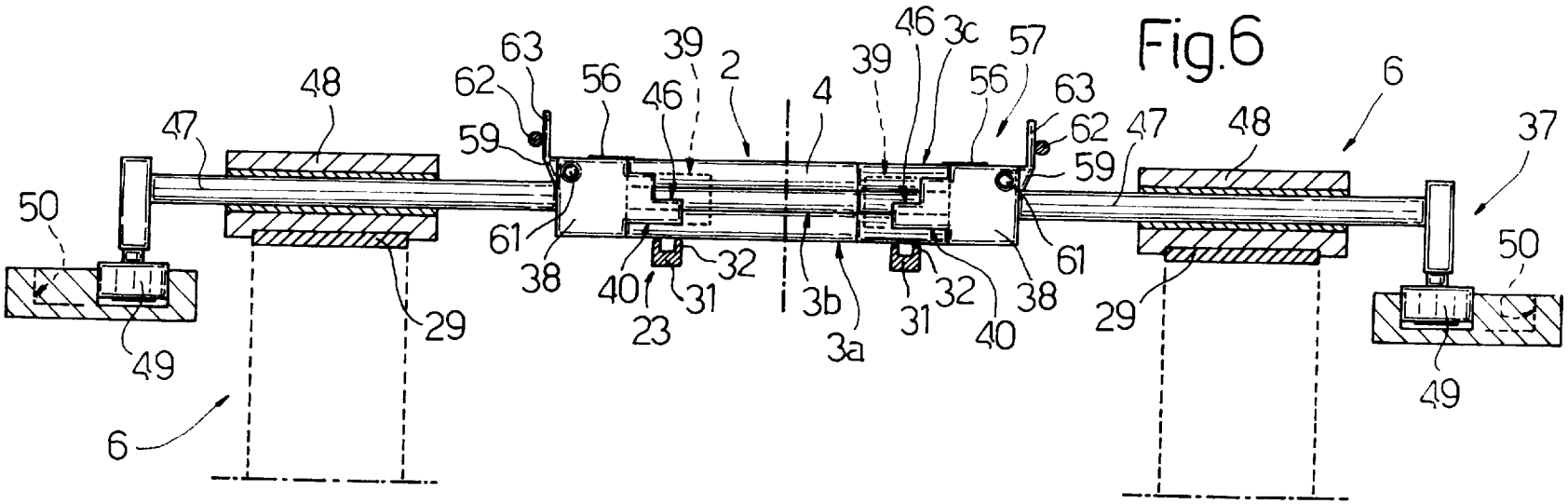
FIG. 6 shows a front view, with parts in section and parts removed for clarity, of a variation of the FIG. 3 detail.

Should the last portion 26*c* be interrupted upstream from station 9, e.g. to enable inspection of groups 2, heads 36 of each pocket 7 must be provided with respective stabilizing blades 56 fitted to the top free ends of respective walls 38, and rotated, by a control device 57 and in opposition to respective springs 58, between a raised idle position (shown to the left in FIG. 7) in which blades 56 are tilted to enable insertion of layer 3 inside pocket 7, and a lowered operating position (shown in FIG. 6 and to the right in FIG. 7) in which blades 56 define respective end portions of outer lateral surface 52 of group 2, and are positioned substantially horizontally on the end portions of cigarettes 4 in layer 3*c* to stabilize cigarettes 4.

More specifically, each blade 56 is fitted to a respective supporting element 59 housed inside a seat 60 in respective wall 38, and comprising, at opposite ends, two pins 61 pivoting on wall 38 about a respective axis parallel to direction D. Control device 57 is located between the last opening 17 and station 9, and comprises two tubular elements 62, which are located on either side of and at a given distance over guide 23, comprise a converging initial portion forming an input funnel, and cooperate with respective arms 63 integral with each element 59 to move respective blades 56 into the lowered position by rotating each element 59 about respective pins 61 and in opposition to springs 58.

Pockets 7 equipped with blades 56 operate in the same way as those without, except that, as layer 3*c* is fed into pocket 7 and pocket 7 is fed between tubular elements 62, blades 56 are lowered to clamp layer 3*c* and also group 2 inside pocket 7. Blades 56 may also be used even in the event the last portion 26*c* extends up to station 9, in which case, the width of portion 26*c* need simply be less than the length of cigarettes 4 to enable blades 56 to be moved into the lowered position.

Finally, should unit 1 provide for forming incomplete groups (not shown), i.e. groups similar to groups 2 but minus one or more cigarettes 4 so as to leave, as stated, one or more gaps (not shown) in the group, each head 36 may be provided, as shown by the dotted lines in FIG. 3, with a number of substantially cylindrical (preferably slightly truncated-cone-shaped) stabilizing cores 64, which ease between cigarettes 4 to fill the gaps during the formation of an incomplete group. Cores 64 are fitted perpendicularly to walls 38, between appendixes 39 and 40, and are movable, together with respective heads 36, between an idle position outside the gaps, and an operating position inside the gaps in group 2 to keep the cigarettes 4 in group 2 in the correct position in relation to one another.

I claim:

1. A method of forming and wrapping a multilayer group of cigarettes, the group having opposite longitudinal end surfaces and a lateral surface, the method comprising advancing a conveying pocket in an advancing direction and through a group forming station; forming said group of cigarettes inside said conveying pocket by feeding said cigarettes into said conveying pocket at said group forming station, said conveying pocket having two opposite retaining heads to engage said opposite longitudinal end surfaces of the cigarettes in said group; advancing said conveying pocket through a group wrapping station so as to engage a wrapping sheet and to fold said sheet at least in a "U" shape about said group and said retaining heads; and withdrawing said retaining heads in a second direction crosswise to said advancing direction so as to release said group.

2. A method as claimed in claim 1, wherein said group is formed on a supporting surface substantially parallel to said advancing direction; and said retaining heads are movable into a gripping position contacting said opposite end surfaces of the cigarettes in the group to retain the cigarettes in position with respect to one another and leave said lateral surface of the group substantially free; the pocket being so moved as to feed the group along the supporting surface, and crosswise to the respective axes of the cigarettes, through supply line extending through said group wrapping station for supplying sheets of wrapping material, so as to engage a said sheet at said wrapping station and fold the sheet onto said lateral surface and about the group.

3. A method as claimed in claim 2, wherein said cigarettes are fed into said pocket in successive layers, said two retaining heads each comprising respective axial appendixes, and being moved in steps into the gripping position, so that, at each step, said axial appendixes retain a said layer in said advancing direction.

4. A unit for forming and wrapping a multilayer group of cigarettes; the group having opposite longitudinal end surfaces and a lateral surface, and the unit comprising a conveyor; a group forming station; a group wrapping station; a conveying pocket, having two opposite retaining heads engaging respective said longitudinal end surfaces of said group, the conveying pocket being movable with said conveyor in an advancing direction and through said group forming and wrapping stations; supply means arranged at said group forming station for feeding cigarettes into said pocket to form said group of cigarettes inside the pocket; a supply line located at said group wrapping station for supplying a sheet of wrapping material in time with said conveying pocket; folding means located at said group wrapping station to fold said sheet at least in a "U" shape about said group; and actuating means associated with said retaining heads for moving the retaining heads in a second direction crosswise to said advancing direction.

5. A unit as claimed in claim 4, wherein said retaining heads are movable into a gripping position contacting said opposite end surfaces to retain the cigarettes in position with respect to one another and leave said lateral surface substantially free.

6. A unit as claimed in claim 5, wherein said supply means comprise a given number of output openings arranged in series in said advancing direction along said conveyor; and transfer means for transferring a respective layer of cigarettes to each output opening, and inserting the respective layer into said pocket; the number of output openings being at least equal to the number of layers of cigarettes in each group.

7. A unit as claimed in claim 6, wherein said retaining heads each comprise respective axial appendixes crosswise to said advancing direction, said actuating means being associated with the retaining heads for moving the retaining heads into said dripping position, in which the axial appendixes of one of the two retaining heads are moved axially towards the axial appendixes of the other of the two retaining heads, so as to retain said group, by means of said axial appendixes, in said advancing direction.

8. A unit as claimed in claim 7, wherein said actuating means are step actuating means for so moving said axial appendixes into the dripping position that, at each step and at each said output openings, said axial appendixes retain a said layer in said advancing direction.

9. A unit as claimed in claim 8, wherein said conveyor extends through said supply line.

10. A unit as claimed in claim 9, further comprising guide means extending parallel to said conveyor in said advancing direction to guide said group, and defining said supporting surface.

11. A unit as claimed in claim 10, wherein said guide means comprise a longitudinal guide having a movable end portion located at said wrapping station, and operating means associated with said end portion and for moving the end portion between a withdrawn position enabling supply of said sheet, and an extracted position supporting said group.

12. A unit as claimed in claim 11, wherein said conveyor comprises two conveyor belts located on either side of said guide; each belt supporting a respective said retaining head.

13. A unit as in claim 6, wherein said transfer means comprise compacting means for compacting each layer inside said pocket and parallel to said advancing direction.

14. A unit as claimed in claim 13, wherein said transfer means are defined by a respective transfer wheel having a number of peripheral sectors; each sector comprising a given number of grooves, each for retaining a respective cigarette.

15. A unit as claimed in claim 14, wherein said compacting means comprise, for each said sector; at least a pair of substantially radial arms integral with the sector and cooperating with the cigarettes in the respective layer to compact the cigarettes inside said pocket.

16. A unit as claimed in claim 14, wherein said compacting means comprise, for each said sector; two pairs of substantially radial arms integral with the sector and cooperating with the cigarettes in the respective layer to compact the cigarettes inside said pocket.

17. A unit as in claim 6, wherein said supply means comprise, for each said output opening, a number of channels for supplying respective columns of cigarettes; each channel comprising a respective bottom opening; and said transfer means being located between the respective output openings and said bottom openings.

18. A unit as claimed in claim 17, wherein said supply means comprise dispensing means located at each bottom opening of each said channel, and for selectively feeding a respective cigarette to said transfer means.

19. A unit as claimed in claim 18, wherein said retaining heads each comprise at least one stabilizing member located crosswise to said advancing direction and movable between an idle position in which the stabilizing member is located outside said pocket; and an operating position in which the stabilizing member is located inside said pocket to keep the cigarettes in said group in the correct position in relation to one another.

20. A unit as claimed in claim 7, wherein said axial appendixes comprise a flat surface facing outwards of the pocket, and a shaped surface facing inwards of the pocket; each flat surface defining with the respective shaped surface two tapered longitudinal edges, which are positioned flush with the cigarettes in said gripping position.

21. A unit as claimed in claim 20, wherein each said retaining head comprises a pair of axial appendixes; one of the axial appendixes in each pair of axial appendixes having a first given length greater than a second length of the other axial appendix; the difference between said first and second lengths being substantially equal to a said step.

22. A unit as claimed in claim 20 wherein each said retaining head comprises a pair of axial appendixes; one of the axial appendixes in each pair of axial appendixes having a flat portion formed on a respective tapered longitudinal edge.

23. A unit as claimed in claim 20, wherein, in said gripping position, the flat surfaces of said axial appendixes define a portion of a substantially free lateral surface of said group.

24. A unit as claimed in claim 7, further comprising stabilizing means associated with said pocket and for stabilizing the cigarettes in said group inside the pocket.

25. A unit as claimed in claim 24, wherein each said retaining head comprises a wall parallel to said given direction; said stabilizing means comprising, for each wall, a stabilizing element defined by a plate fitted to the respective wall at a top free end of the wall.

26. A unit as claimed in claim 25, further comprising control means located upstream from said wrapping station in said advancing direction, and for moving said stabilizing elements between an idle position enabling insertion of said cigarettes inside said pocket, and a retaining position in which said stabilizing elements are positioned along respective end portions of said lateral surface of said group.

* * * * *